US006098587A

United States Patent [19]

Malss et al.

[11] Patent Number: 6,098,587

[45] Date of Patent: Aug. 8, 2000

[54] OIL SUPPLY METHOD FOR AN INTERNAL COMBUSTION ENGINE

[75] Inventors: Stephen Reinhard Malss, Woodvale; David Richard Worth, Shenton Park, both of Australia

[73] Assignee: Orbital Engine Company Australia, Balcatta, Australia

[21] Appl. No.: 09/077,896

[22] PCT Filed: Dec. 13, 1996

[86] PCT No.: PCT/AU96/00807

§ 371 Date: Aug. 26, 1998

§ 102(e) Date: Aug. 26, 1998

[87] PCT Pub. No.: WO97/22784

PCT Pub. Date: Jun. 26, 1997

[30] Foreign Application Priority Data

Dec. 15, 1995 [AU] Australia ..... PN 7165

[51] Int. Cl.[7] ..... F01M 1/00

[52] U.S. Cl. ..... 123/196 R; 123/73 AD; 123/196 S; 184/6.3

[58] Field of Search ..... 123/73 AD, 196 R, 123/196 S, 196 M; 184/6.3

[56] References Cited

U.S. PATENT DOCUMENTS

| | | | |
|---|---|---|---|
| 4,765,291 | 8/1988 | Kurio et al. | 123/196 R |
| 4,774,918 | 10/1988 | Kurio et al. | 123/196 R |
| 4,989,555 | 2/1991 | Matsuo et al. | 123/73 AD |
| 5,114,573 | 5/1992 | Frostick | 210/136 |
| 5,159,313 | 10/1992 | Kawai et al. | 340/450.3 |
| 5,526,783 | 6/1996 | Ito et al. | 123/196 S |

FOREIGN PATENT DOCUMENTS 0 508 486 10/1992 European Pat. Off. .

OTHER PUBLICATIONS

Patent Abstracts of Japan, M–1533, p. 34, 5–240016, Sep. 17, 1993.

*Primary Examiner*—Willis R. Wolfe
*Assistant Examiner*—Brian Hairston
*Attorney, Agent, or Firm*—Nikaido, Marmelstein, Murray & Oram LLP

[57] ABSTRACT

A method of controlling the oil flow rate for an internal combustion engine including: a) defining a break-in period of the engine; b) determining whether the engine is running within the break-in period; and c) varying the oil flow rate for the engine if the engine is running within said break-in period from the oil flow rate for the engine when running under normal conditions outside the break-in period such that the oil flow rate during the break-in period is generally higher than the oil flow rate under normal engine conditions.

18 Claims, No Drawings

OIL SUPPLY METHOD FOR AN INTERNAL COMBUSTION ENGINE

The present invention is generally directed to the control of the flow rate of lubrication oil to an internal combustion engine.

A newly manufactured engine or an engine that has been re-built or reconditioned typically must initially run through a "break-in" period to thereby reduce the frictional resistance between mating components within the engine and enable the components thereof to bed-in. During this initial break-in period of the engine, it would be advantageous to provide a different oil flow rate (generally higher) in comparison to the standard oil flow rate provided after the engine has completed a reasonable break-in period. This allows the engine to be run-in at a more appropriate oiling rate, reducing the risk of causing undue damage to the engine.

However, the use of higher than normal oil flow rates after the engine has been broken-in is undesirable. In addition to the engine simply consuming more oil, higher oil flow rates can also result in damage to any catalytic converter used in the engine exhaust system as unburnt hydrocarbons from the oil are passed through the engine at a higher rate and are embedded in the catalyst, contaminating it and reducing its effectiveness. Over-oiling can also affect spark plug performance. Accordingly, it would be advantageous to determine whether an engine is running within its break-in period to thereby know when the higher oil flow rate is required.

It is an object of the present invention to provide an improved method of controlling the oil flow rate to an internal combustion engine, particularly a crankcase scavenged two-stroke engine.

With this in mind, the present invention provides a method of controlling the oil flow rate for an internal combustion engine including:

a) defining a threshold value or an engine operating parameter;
b) defining a break-in period of the engine;
c) determining whether the engine is running within the break-in period; and
d) increasing the oil flow rate for the engine from the oil flow rate for the engine when running under normal engine conditions outside the break-in period if the engine is running above said threshold value within said break-in period such that the oil flow rate during the break-in period is generally higher than the oil flow rate under normal engine conditions.

The fuel to oil ratio may be decreased when the engine is running in its break-in period which results in the oil flow rate during the engine break-in period being higher than the oil flow rate to the engine after the break-in period.

Decreased fuel to oil ratio may be simply achieved by increasing the standard oil flow rate by a given factor (for example×1.5) or by a set amount for the duration of the break-in period. However, the increase in oiling rate can be achieved in accordance with the invention in a variety of different ways, providing additional benefits. The increase in oiling rate, or decrease in fuel to oil ratio, can be made a function of the engines current operating parameters, thus adapting the oiling rate more closely to the requirements of the new engine.

For example, the oil flow rate variation may be a function of engine speed, so that below a given engine speed the oiling rate is not altered during break-in, but above that given engine speed, the oiling rate is substantially increased.

This functional dependence on the current operating conditions of the engine can be particularly advantageous in avoiding over-oiling at times when the oil requirements are minimal, such as at idle. Over oiling such as this can lead to, for example, spark plug malfunction as the electrodes may become clogged or fouled with oil.

Current operating conditions on which the break-in oiling rate is made dependent can be one or more of many operating parameters of the engine. As discussed above, current engine speed may be used. Other parameters which may be used to determine oiling rate include load, power output, engine running time since new, and total number of engine cycles since new.

It is possible, using a combination of these parameters to define a graduated strategy where the increased oil flow decreases over time (or engine use etc) so that at the end of the break-in period the oiling rate has been decreased to a level where it becomes the same as the standard oiling rate.

In regard to this graduated strategy, the break-in period can be defined as being a significant portion of the life of the engine such that the oiling rate decreases at a steady rate over this portion of the engine's life. The strategy need not be graduated linearly but could be a function of a polynomial or have different graduations or set points for oil flow rate therein.

The break-in period of the engine may be defined as a threshold period of running time from the first start-up of the new or rebuilt engine. The engine operating status may then be determined by adding the running periods of time of the engine thereto after initial start-up thereof and determining whether the total calculated running periods exceed the break-in threshold period. Alternatively, the break-in period may be defined as a threshold distance of travel of the vehicle powered by the engine. The engine operating status may then be determined by adding the total distance travelled by the vehicle or craft from initial start-up of the engine.

This may however not be an appropriate method of defining the break-in period when the engine has spent a large proportion of its running time at or near idle. Therefore, the break-in period may alternatively be defined as a total period of running time of the engine when the average fuel supply rate to the engine (which is, by its nature related to the operating load of the engine) is above a threshold fuel supply rate. The engine operating status may then be determined by adding all the running periods following the first start-up of the engine where the average fuel supply rate is above that threshold fuel supply rate, and adding the said running periods to thereby determine whether the engine is still running within its break-in period.

Alternatively, the break-in period may be defined as a total period of running time of the engine when the engine speed is above a threshold speed. The engine operating status can then be determined by adding the running periods of the engine following the first start-up of the engine when the average engine speed is above the threshold speed. It is also envisaged that the break-in period may be defined as the total period of running time of the engine when the average engine load is above a threshold load. Furthermore, the break-in period may be defined as a function of the total amount of additional oil used over the life of the engine. This is particularly useful where the amount of additional oil used is dependent on the load/speed of the engine.

This is because more oil is used at higher engine speeds and hence the higher the average engine speed, the more oil is used. Higher engine speeds typically result in faster breaking-in of the engine. As such, total oil usage reflects the "break-in" state of the engine. A higher total oil usage over a shorter period of time therefore equates to a shorter break-in period.

Yet a further alternative would involve the application of certain weighting factors for certain engine operating point. Thus, the time that an engine spent at idle could carry a low weighting (perhaps a "0") whilst the time the engine spends at an operating point which is considered an ideal "break-in" point (say medium speed or high load) could carry a higher weighting factor (perhaps "1"). In this way, all engine operating conditions could be given a weighting to be applied to the time spent at that operating condition prior to the summation of the total engine operating time.

A map providing oiling rate values on the basis of engine operating parameters may be utilised. It is envisaged that during the break-in period of the engine, an addition is made to the standard mapped value of oiling rate, the addition being determined according to the engine operating conditions and a determination of what stage in the break-in period the engine has reached. Alternatively, a separate oiling map may be provided for use only during the break-in period. Once a determination has been made that the break-in period is completed, the electronic controller switches to the standard oiling rate map. It is also envisaged that in the case of rebuilt or reconditioned engines, the engine control system can be reset to register a new break-in period for the engine. To this end, means may be provided to reset the system to the above noted additional entries or the separate break-in oiling map.

The increased oil flow may be directed to the entire engine. It is however also envisaged that the oil may be specifically directed to certain parts of the engine which particularly require the increased oil supply during the break-in period.

A preferred arrangement according to the present invention will now be described. It should however be appreciated that other arrangements are also envisaged.

The method according to the present invention is applicable for an internal combustion engine supplied with lubrication oil by an electronic oil pump which is itself controlled by an electronic control unit (ECU). This ECU control allows the flexibility of varying the rates of oil injection using various strategies thereby allowing variable oil flow control.

The oil flow to the engine can be defined as follows:

$$\frac{\text{Fuel Flow}}{\text{Oil Flow}} = \text{Fuel Oil Ratio}$$

The oil flow rate is increased by decreasing the fuel/oil ratio. To avoid problems with excess oiling, which may cause spark plug fouling for example, the fuel/oil ratio is preferably altered depending upon engine load.

In accordance with the present invention, a break-in period is defined, and the level of additional oiling is also defined. Both of these parameters may be defined as a function of engine operating conditions, therefore do not necessarily have fixed or known values at the start of the break-in period. Additional oil is provided to the engine during the break-in period in accordance with the defined additional oiling regime.

The break-in period can be defined in terms of an engine speed threshold. If the engine speed is greater than this threshold, then the engine is within the break-in region. The engine is considered to have finished its break-in period when the total time spent within the break-in region is greater than the predetermined break-in period.

During the break-in period the fuel/oil ratio is decreased by a break-in percentage value. This results in an overall higher oil flow. To allow for different oil flow rates depending on the engine load and other engine operating parameters, a look-up map having fuel supply rate and engine speed as coordinates can be used to determine the break-in percentage value. The fuel/oil ratio is therefore as follows:

$$\text{Fuel/oil ratio} = \text{fuel/oil ratio} - \frac{(\text{fuel/oil ratio} \times \text{break-in}\,\%)}{100}$$

The base fuel/oil ratio is determined using the normal look-up map used after the engine is broken-in.

It should be appreciated that the break-in period can be determined in many alternative ways according to the present invention. For example, the oil flow rates can be varied as a function of one or more engine parameters including the proportion of the break-in period through which the engine has already passed through. Different engine management maps may be provided in the ECU as required to operate under the many strategies available.

We claim:

1. A method of controlling the oil flow rate for an internal combustion engine including:

a) defining a predetermined threshold value of an engine operating parameter;

b) defining a break-in period of the engine;

c) determining whether the engine is running within the break-in period; and d) increasing the oil flow rate for the engine from the oil flow rate for the engine when running under engine conditions outside the break-in period if the engine is running above said threshold value within said break-in period such that the oil flow rate during the break-in period is relatively higher than the oil flow rate under engine conditions after the break-in period.

2. A method according to claim 1 wherein the threshold value is a threshold fuel supply rate above which the oil flow rate is increased.

3. A method according to claim 1 wherein the threshold value is a threshold engine speed above which the oil flow rate is increased.

4. A method according to claim 1 wherein the threshold value is a threshold engine load above which the oil flow rate is increased.

5. A method according to claim 1 wherein the threshold value is a threshold engine power output above which the oil flow rate is increased.

6. A method according to claim 1, the break-in period of the engine being defined as a threshold running period of the engine from the first start-up of the engine, including adding the running periods of the engine after first start-up thereof, and determining whether the total calculated running period exceeds the threshold running period to thereby determine whether the engine is running within the break-in period.

7. A method according to claim 1, the break-in period of the engine being defined as a threshold distance of travel of the vehicle powered by the engine from the first start-up of the engine, including adding the distances travelled by the vehicle after first start-up thereof, and determining whether the total calculated distance exceeds the threshold distance to thereby determine whether the engine is running within the break-in period.

8. A method according to claim 1, the break-in period of the engine being defined as a total running period of the engine from the first start-up when the total amount of oil used since the beginning of the break-in period reaches a predetermined amount.

9. A method according to claim 1 including applying weighting factors for different operating conditions, the duration of time spent at any given operating condition being multiplied by the weighting factor for that operating condition, and the break-in period being defined as a function of the summation of the total weighted operating time of the engine.

10. A method according to claim 9, wherein the weighting factor for any given operating condition varies between zero and one, the weighting factor when the engine is at idle being zero, the weighting factor when the engine is at high load being one.

11. A method according to claim 9, wherein a predetermined value is provided and the break-in period of the engine is defined as finishing when the summation of the total weighted operating time of the engine reaches said predetermined value.

12. A method according to claim 1, the break-in period of the engine being defined as a total running period of the engine from the first start-up of the engine when the average fuel supply rate to the engine is above a threshold fuel supply rate, including adding all the running periods of the engine after the first start-up thereof where the average fuel supply rate is above the threshold fuel supply rate, and determining whether the total calculated running period exceeds said total running period to thereby determine whether the engine is running within the break-in period.

13. A method according to claim 1, the break-in period of the engine being defined as a total running period of the engine from the first start-up of the engine when the speed of the engine is above a threshold speed, including adding the running periods of the engine after the first start-up thereof when the average engine speed is above the threshold speed, and determining whether the total calculated running period exceeds said total running period to thereby determine whether the engine is running within the break-in period.

14. A method according to claim 1, the break-in period of the engine being defined as a total running period of the engine from the first start-up of the engine when the average load of the engine is above a threshold load, including adding the running periods of the engine after the first start-up thereof when the average engine load is above the threshold load, adding the running periods, and determining whether the total calculated running period exceeds said total running period to thereby determine whether the engine is running within the break-in period.

15. A method according to claim 1, the break-in period of the engine being defined as a total running period of the engine from the first start-up of the engine when the average power output of the engine is above a threshold engine power output, including adding the running periods of the engine after the first start-up thereof when the average engine power output is above the threshold engine power output, adding the running periods, and determining whether the total calculated running period exceeds said total running period to thereby determine whether the engine is running within the break-in period.

16. A method according to claim 1 including determining the oil supply rate to the engine under said engine conditions outside the break-in period, determining an additional oil supply rate as a function of engine operating conditions and a stage in the break-in period the engine has reached, the oil supply rate to the engine being the summation of the oil supply rate under said engine conditions outside the break-in period and the additional oil supply rate.

17. A method of controlling a positive oil flow rate for an internal combustion engine comprising:

(a) determining whether the engine is running within a break-in period of the engine;

(b) determining whether the engine is running above a predetermined threshold value of an engine operating parameter;

(c) in response to the determinations in steps (a) and (b), controlling the positive oil flow rate for the engine according to a first mode when (i) the engine is running outside the break-in period and the engine is running above the threshold value, (ii) the engine is running outside the break-in period and the engine is running below the threshold value, and (iii) the engine is running within the break-in period and the engine is running below the threshold value; and (d) in response to the determinations in steps (a) and (b), controlling the positive oil flow rate for the engine according to a second mode when the engine is running within the break-in period of the engine and above the threshold value;

wherein, for the same engine operating conditions, the second mode causes a higher positive oil flow rate than the first mode.

18. A method of controlling a positive oil flow rate for an internal combustion engine comprising:

(a) determining whether the engine is running within a break-in period of the engine;

(b) determining whether the engine is running above a predetermined threshold value of an engine operating parameter;

(c) in response to the determinations in steps (a) and (b), controlling the positive oil flow rate for the engine according to a first mode when the engine is running within the break-in period and the engine is running below the threshold value; and (d) in response to the determinations in steps (a) and (b), controlling the positive oil flow rate for the engine according to a second mode when the engine is running within the break-in period of the engine and above the threshold value;

wherein, for the same engine operating conditions, the second mode causes a higher oil flow rate than when the engine is running outside the break-in period.

* * * * *